US005189836A

United States Patent [19]

Alder et al.

[11] Patent Number: 5,189,836

[45] Date of Patent: Mar. 2, 1993

[54] AUTOMATED INSPECTION PIT COVER SYSTEM

[76] Inventors: Matt L. Alder, 3302 E. Splendor Way, Salt Lake City, Utah 84124; L. Cliff Payzant, 7276 S. 2870 East, Salt Lake City, Utah 84121

[21] Appl. No.: 780,411

[22] Filed: Oct. 18, 1991

Related U.S. Application Data

[63] Continuation of Ser. No. 610,358, Nov. 7, 1990, abandoned.

[51] Int. Cl.[5] ..... E06B 11/00

[52] U.S. Cl. ..... 49/33; 49/27; 49/360; 137/234.6

[58] Field of Search ..... 52/169.6

[56] References Cited

U.S. PATENT DOCUMENTS

| | | | |
|---|---|---|---|
| 1,832,232 | 11/1931 | Mimms . | |
| 2,135,131 | 11/1938 | Bassett | 49/27 X |
| 2,137,196 | 11/1938 | Sampson | 49/13 X |
| 2,598,196 | 5/1952 | Staley | 49/13 X |
| 2,841,389 | 7/1958 | Litherland | 49/27 |
| 3,079,871 | 3/1963 | Brodie | 137/234.6 X |
| 3,238,772 | 3/1966 | Pelliciotti | 137/234.6 X |
| 3,299,570 | 1/1967 | Radcliffe | 49/360 X |
| 3,475,862 | 11/1969 | Ozaki | 49/360 |
| 3,775,906 | 12/1973 | Dougherty | 49/360 X |
| 3,855,733 | 12/1974 | Miller | 49/27 X |
| 3,938,621 | 2/1976 | Bobbitt | 137/234.6 X |
| 4,188,985 | 2/1980 | Osterman | 137/234.6 X |
| 4,284,173 | 8/1981 | Patterson | 137/234.6 X |
| 4,301,621 | 11/1981 | Houweling . | |
| 4,301,627 | 11/1981 | Houweling | 49/27 |
| 4,464,518 | 8/1984 | Duhame | 49/31 X |
| 4,464,651 | 8/1984 | Duhame . | |
| 4,503,637 | 3/1985 | Parente | 49/360 X |
| 4,693,340 | 9/1987 | Shanks et al. | 49/27 X |
| 4,763,937 | 8/1988 | Sittnick et al. | 49/31 X |
| 4,785,293 | 11/1988 | Shearer et al. | 49/31 X |
| 4,789,047 | 12/1988 | Knobloch | 137/234.6 X |
| 4,821,024 | 4/1989 | Bayha | 49/30 X |
| 4,937,556 | 6/1990 | Scott et al. . | |
| 4,960,150 | 10/1990 | Ryan | 49/127 X |

*Primary Examiner*—Renee S. Luebke
*Assistant Examiner*—Jerry Redman
*Attorney, Agent, or Firm*—Thorpe, North & Western

[57] ABSTRACT

A system for automatically opening and closing horizontal covers over standard inspection pit. The system comprises two grates mounted on wheels, the wheels engaging two parallel tracks attached to opposite sides of the pit. An electric motor powers the grates upon command to either move away from each other to an open position to expose the pit, or to move toward each other to a closed position to cover the pit. The system is equipped with both audible and visual warning devices which automatically activate upon movement of the grates. Also, the leading edges of the grates have sensors which cause the grates to stop and retract upon detection of a foreign object caught therebetween.

3 Claims, 3 Drawing Sheets

AUTOMATED INSPECTION PIT COVER SYSTEM

This application is a continuation of U.S. application Ser. No. 07/610,358, filed Nov. 7, 1990, of MATT L. ALDER ET AL. for AUTOMATED INSPECTION PIT COVER SYSTEM, now abandoned.

BACKGROUND OF THE INVENTION

1. Field

This invention relates generally to the field of automatic door systems and more particularly to a novel system for covering and uncovering inspection pits.

2. Prior Art

Inspection pits are widely used for a variety of purposes, including, but not limited to the automotive or trucking industry such as the facility of changing the oil, lubrication and maintenance on a vehicle, and inspection of otherwise difficult to access portions on a vehicle. Generally, such pits are located in an automotive garage or similar location, but are known to exist at virtually any location in which the above-mentioned duties are performed.

A standard inspection pit comprises a relatively long, slender, box-like cavity having a sufficient depth for an average person to stand erect. The width thereof will generally not exceed three or four feet in order to allow a standard passenger vehicle or truck to straddle the pit.

Most pits are formed of concrete or a similar building material to ensure against collapse of the cavity due to the weight of the vehicle straddling it. Steps located at one or both ends of the pit allow ingress and egress. Alternatively, some pits even have an open vertical wall adjacent to a neighboring subterranean room to provide easier access thereto.

Inspection pits are notoriously dangerous, providing a multitude of possibilities for injury to people and/or property For example, if the driver of a vehicle which is being maneuvered to straddle a pit misjudges or miscalculates the often times small clearances between the vehicle's wheels and the edges of the pit, a portion of the vehicle will fall into the pit. This can not only harm the driver, but anyone who may have been in the pit at the time of miscalculation. Furthermore, because of the vehicle's weight, generally the only way to retrieve it from the pit after it falls thereinto is to engage the services of a tow truck, which adds to the already substantial costs of repair.

Taken in another context, an inspection pit presents a potential danger to a passersby, who may be unaware of or may have momentarily forgotten about its presence. There are also those who may slip on spilled oil or trip on other obstacles in the vicinity of the pit and thereby fall into the pit.

Therefore, it becomes desirable at times to cover an inspection pit, especially when the pit is not in use or unsupervised. There are covers known in the prior art which overlay the exposed portion of a pit and these generally comprise just a solid or perforated sheet of structural steel or other similar material having sufficient structural integrity. Prior art covers, however, must be manually retracted or replaced, often requiring the services of two or more individuals. Also, the times during which the covers are moved into a desired position present an unduly high risk of an operator slipping and falling into the pit, since the covers are quite heavy and the footing precarious because of the close proximity of the pit.

Some prior art covers have the disadvantage of uncovering only a small portion of the pit at any one time. While this approach may significantly diminish the chances of accidents, it is also inconvenient since only a small portion of a vehicle can be serviced at any one time, the vehicle having to be moved before further work can be accomplished.

Prior art covers have the further disadvantage of not being equipped with warning devices which notify those in the vicinity when the covers are to be moved. Thus, when a person in the pit is unaware that the covers are being moved, he or she is in a real danger of being struck or otherwise injured.

BRIEF SUMMARY OF THE INVENTION

Accordingly, it is a principal objective of the present invention to provide a system for automatically opening and closing the covers of an inspection pit.

Another major objective is the provision of an inspection pit with automatically actuated covers equipped with a warning mechanism to notify all persons in the area when the covers are in motion.

Still another important objective is to provide a set of automatically openable and closeable inspection pit covers which stop and/or retract upon impact with a foreign object during the closing of the covers.

Another primary purpose of the invention is the provision of covers which may alternatively completely cover and completely expose the cavity of an inspection pit, and which are effectively out of the way when the cavity is exposed.

A further objective is to provide an automatic system for opening and closing the covers of an inspection pit which is safe, low maintenance, relatively inexpensive, easily installed and easily manufactured.

In brief summary, this invention comprises a pair of slidably mounted so as covers or grates which can be automatically moved apart from one another to expose an inspection pit, or in the alternative can be moved towards each other to cover the pit. Each cover is mounted to freely move on tracks, the tracks being long enough to allow full retraction of the covers to completely expose the pit. The leading edges of the covers may be padded and equipped with sensors such that when the edges encounter a foreign object when closing, the covers automatically stop and retract.

A switching control panel is mounted on a nearby wall or other suitably accessible position and includes controls to cause a motor to drive a sprocket which engages a drive chain or belt, the drive chain or belt also being secured at its ends to a cover. A second electric motor, sprocket and drive chain or belt assembly are similarly connected to the other cover. Each drive chain or belt is also engaged by idler gears which maintain a desired tautness.

In accordance with one aspect of the invention, when the covers are activated by the switching control panel to cause movement thereof, a visual alarm and/or an audible alarm are automatically activated to alert and warn those in the vicinity that the covers are in motion.

BRIEF DESCRIPTION OF THE DRAWINGS

These and other objects, features and advantages of the present invention will become apparent from a consideration of the following detailed description presented in connection with the accompanying drawings in which.

DETAILED DESCRIPTION

Reference is now made to the drawings in which like materials are designated to represent like components throughout. A presently preferred system for automatically covering and uncovering an inspection pit is shown herein to comprise a pair of moveable rectangular covers or grates 4 and 8 which alternatively slide apart to permit access to and move together to deny access to a standard inspection pit 12.

The inspection pit 12 upon which this invention best operates is a generally rectangular box-shaped subterranean cavity having concrete, or similarly reinforced walls. Such a pit 12 in use accommodates a person who is to inspect or otherwise maintain a vehicle which straddles the longitudinal axis of the pit. Thus, a preferred pit 12 will be of a sufficient depth that an average person can comfortably stand up therein to reach a plane intersecting the axles of the straddling vehicle. It will also be recognized that the pit 12 will not have a transverse width greater than the wheel base of a vehicle to be serviced.

Covers 4 and 8 are preferably formed of perforated steel such as that used on a catwalk or similar structure where sight access through the grating is desirable. However, it should also be realized that for purposes of this invention a solid cover is also contemplated and fits squarely within the scope thereof. The preferred grates 4 and 8 can easily accommodate the weight of several persons walking thereon at one time and also have sufficient structural integrity to prevent the wheel of a vehicle from falling through the space spanned by each grate 4 and 8.

Figure 3:
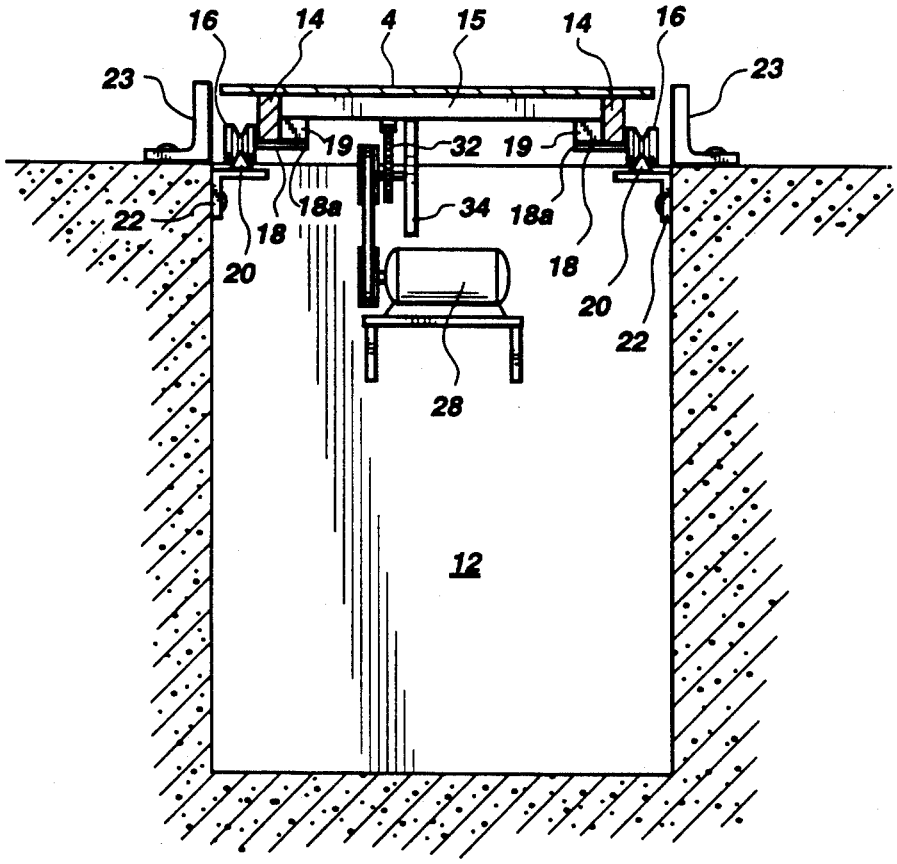
FIG. 3 is a front elevational view of the pit cover system of FIG. 1 taken along the lines 3—3 of FIG. 2, illustrating the wheels and tracks upon which the covers ride.
Figure 4:
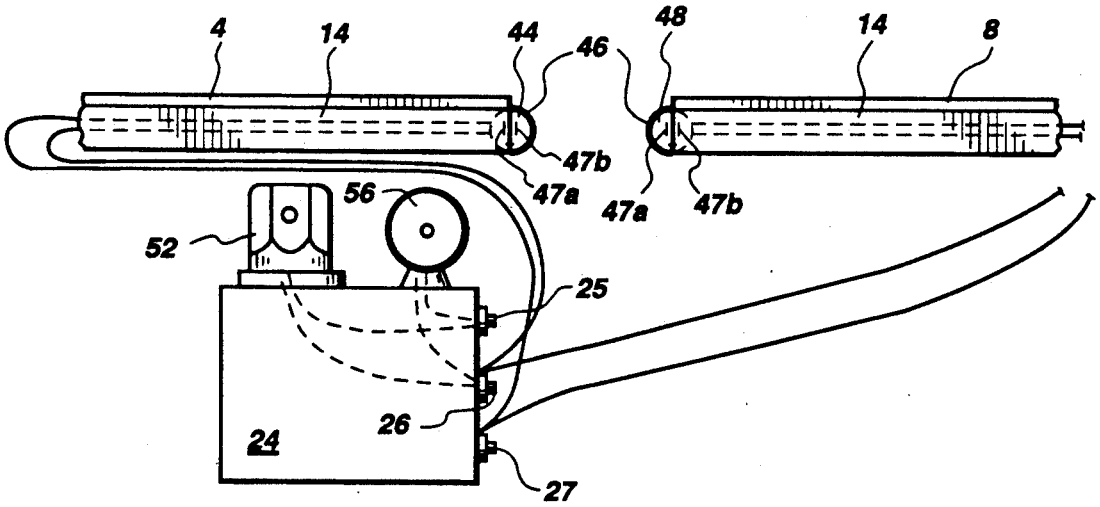
FIG. 4 is a partial schematic view of a warning and safety system feature of the invention of FIG. 1.

Each grate 4 and 8 is reinforced near its periphery by standard hollow structural tubing 14 and 15. Tubing 14 which is parallel to the longitudinal axis of each grate 4 and 8 is rectangular in cross section, a shorter edge of the rectangle being attached, as by welding, to the bottom broadface of each grate 4 and 8 a few inches from the edge thereof, as best shown in FIG. 3. Tubing 15, located at the ends of each grate 4 and 8 parallel to the transverse axis thereof, is square in cross section, one edge of the square being attached, as by welding, to the bottom broadface of the grates 4 and 8 a few inches from the edge thereof. The ends of each length of tubing 15 are firmly secured to an end of a length of tubing 14 to form an overall rectangular shape.

Figure 5:
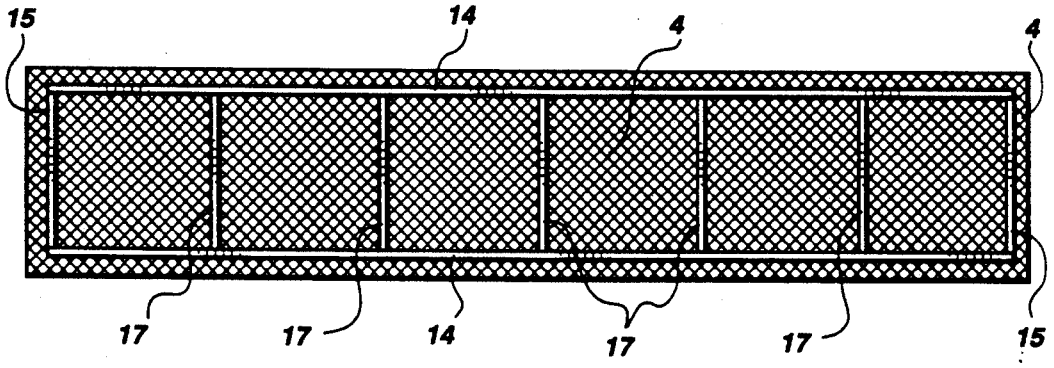
FIG. 5 is a bottom plan view of a preferred inspection pit cover illustrating the reinforcing tubing.

Also, transverse ribs 17 (FIG. 5), are intermittently spaced along the length of each grate 4 and 8 to further fortify each. Each rib 17 is securely attached, as by welding, to the bottom broadface of a grate 4 or 8 along one cross sectional edge thereof and also attached at each end to a length of longitudinal rectangular tubing 14.

Each grate 4 and 8 is equipped with grooved wheels 16, which allow the grates to roll freely along an engaging track, described hereinafter. A wheel 16 is situated near each corner of rectangular grates 4 and 8 on both long sides or intermittantly as required. Each wheel 16 has an inwardly disposed axle 18, one end of which penetrates the center of the wheel 16 and permits rotation thereabout. The other end **18*a* of axle 18 is securely attached to rectangular tubing 14 which reinforces the grates 4 and 8. As the attached end 18*a* extends beyond rectangular tubing 14, as shown in FIG. 3, a small block 19 is welded or otherwise attached to the rectangular tubing 14 and to a rib 17 which is situated so as to be coaxial with an axle 18. Attached end 18*a* is also securely attached to the small block 19**.

A long, slender base support track 20, having a triangular cross section, is mounted on each of the two upper longitudinal edges of the pit 12, the upper pointed portions of each triangular track 20 being engaged by the grooved portion of a wheel 16. Each track 20 has a length approximately twice that of the pit 12, the middle one-half of each track 20 extending along the length of the pit 12 and the remaining one-fourth at each end being securely fastened to the ground or floor of the building in which the pit 12 is situated.

The middle one-half of each track 20 is securely fastened, as by welding, to an L-shaped angle iron support 22 which is securely fastened, preferably with bolts, near the top of a long vertical wall of the pit 12. See FIG. 3. Thus, one exterior face of each angle iron support 22 is securely fastened to a track 20, while the second exterior face thereof is securely fastened to a vertical wall in the inspection pit 12. Because each track 20 has a continuous cross section throughout its length, the wheels 16 are free to move up and down the track as directed by the operator.

An L-shaped angle iron 23 is fastened near each upper horizontal edge of the pit 12, each angle 23 extending the entire length thereof. Angle irons 23 prevent access by persons or objects to the wheels 16. As illustrated in FIG. 3, angle irons 23 are fastened only to the ground and do not touch or otherwise interfere with the movement of the two covers 4 and 8.

Covers 4 and 8 are automatically opened and closed by an operator at a control box 24 who initiates one of three options: an open switch 25, a close switch 26 or a stop switch 27. The open option 25 retracts the covers 4 and 8 from a position in which the leading edges thereof are in contact to a position in which the leading edges are apart. The close option 26 shuts the grates 4 and 8 from a position in which the leading edges are apart to a closed position in which the same edges are in contact. The stop option 27 simply stops all movement of the grates 4 and 8 regardless of their location or direction of movement.

Figure 1:
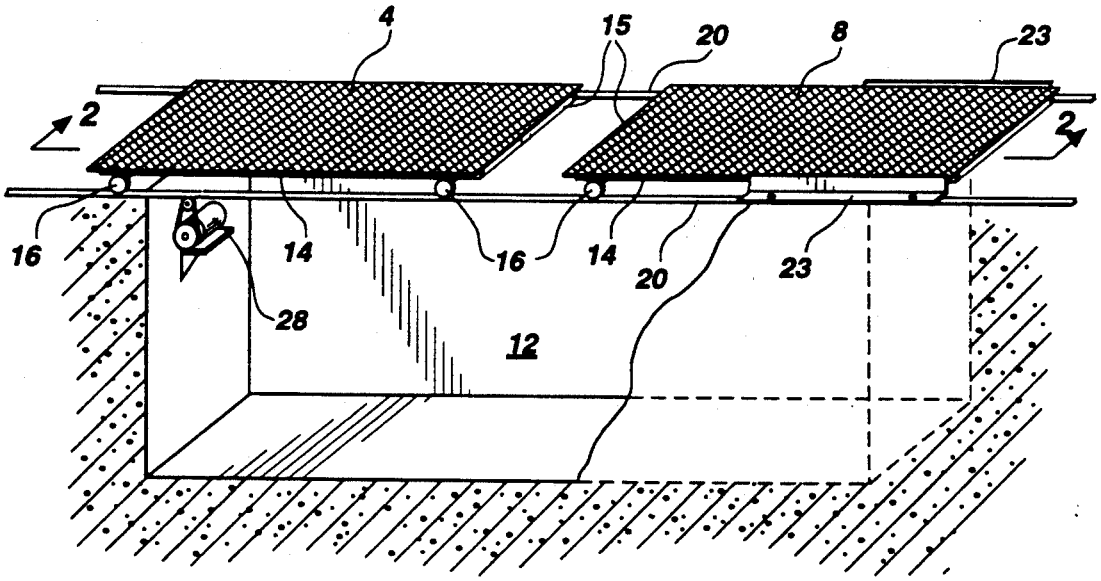
FIG. 1 is a partially cutaway perspective view of a preferred automated inspection pit cover system, showing covers in a partially open position, according to the present invention.
Figure 2:
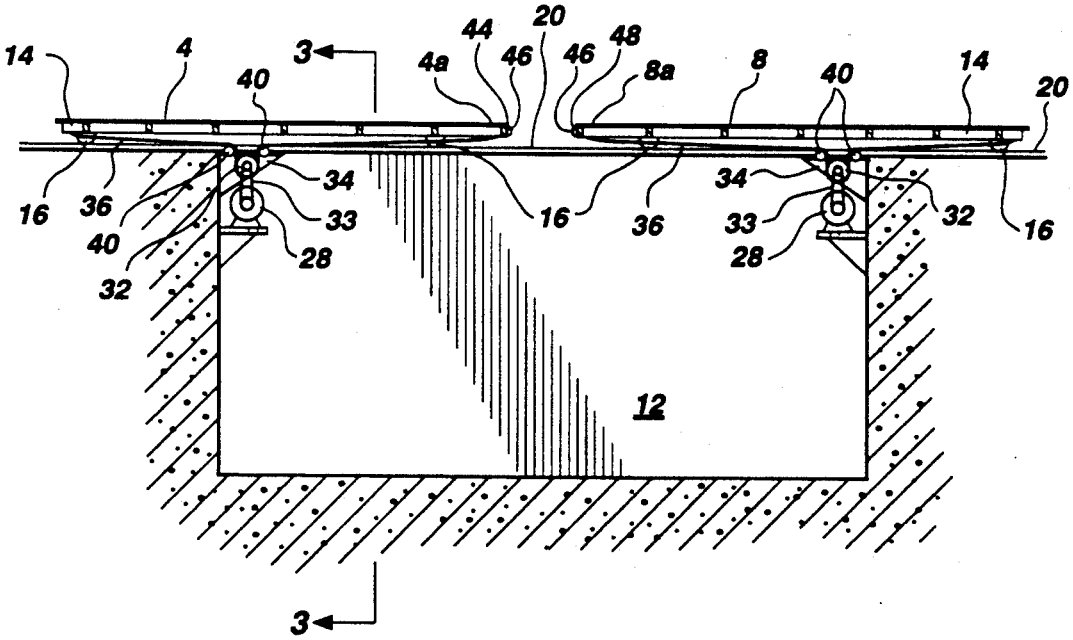
FIG. 2 is a side elevational view of the pit cover system of FIG. 1 taken along the lines 2—2 of FIG. 1, illustrating the sprocket and drive chain assemblies.

Each of the options 25, 26 and 27 in control box 24 is connected to two identical corresponding electric motors 28, one rigidly mounted on each transverse vertical wall of the pit 12, as shown in FIG. 2 to provide electromotive power to a grate 4 or 8. While other forms of power, such as hydraulics, are contemplated, the preferred motors 28 are high-starting torque, reversible, constant duty, Class A insulated electric motors with overload protection. Both are sized to have sufficient power to move a cover 4 or 8 in either direction along the tracks 20 from any position at a preferred rate of not less the two-thirds feet per second nor more than one foot per second.

Each electric motor 28, upon command from the control box 24, turns a drive sprocket 32, the sprocket 32 and electric motor 28 being connected by a standard closed loop drive belt 33. A sprocket 32 is mounted near the top of each transverse vertical wall of the pit 12, either independently with brackets 34, as shown in FIG. 2, or to the electric motor 28 to which sprocket 32 is connected. Sprocket 32 also engages a standard drive chain 36, one end thereof being connected near a leading transverse edge 4*a* or 8*a* of grate 4 or 8 respectively. The opposite end of chain 36 is attached to the opposite or rear transverse edge of grate 4 or 8.

Referring to FIG. 2, two idler gears 40, one located on either side of each sprocket 32, take up slack in the chain 36 to maintain a desired tautness therein to prevent chain 36 from becoming disengaged from the sprocket 32. Idler gears 40 are biased, as with a spring (not shown), to maintain such a tautness. The idler gears 40 are mounted either to the bracket 34 which supports each sprocket 32, or to the electric motor 28. Alternatively, the gears 40 may be independently attached in an appropriate manner to the vertical transverse walls of the pit 12.

Thus, it can be seen that each drive chain 36, which is attached at its ends to the two transverse edges of a grate 4 or 8, substantially follows the major plane of the grates 4 and 8 until reaching an idler gear 40, at which point chain 36 makes an approximate ninety degree turn downward around gear 40 to engage sprocket 32. The chain 36 then turns one hundred eighty degrees about the sprocket 32 to extend upwardly and around the second idler gear 40 at a ninety degree angle to once again become coplanar with the grates 4 and 8. Upon activation of the open switch 25 or close switch 26 in control box 24, the electric motor 28, preferably using the existing electric power supply of the building in which the pit 12 is housed, moves the belt 33 which in turn rotates the sprocket 32 to put chain 36 in motion. As chain 36 is firmly attached to grate 4 or 8, the grate will either open or close as directed.

As an added feature to the present invention, warning and safety systems have been added to minimize the inherent dangers which exist in operating and maintaining an inspection pit. A contemplated safety system comprises sensors 44 and 48 located in leading transverse edges 4*a* and 8*a* of the covers 4 and 8 respectively. Sensors 44 and 48 each extend the full width of the leading edge 4*a* and 8*a* to which they are connected. Both sensors 44 and 48 preferably comprise a strip of compliant, resilient neoprene or rubber 46 which has an exposed portion having the overall shape of a sideways U. One end of each U is firmly secured to the top of a leading edge 4*a* or 8*a*, while the opposite end is similarly secured to a bottom edge thereof. A pair of contact elements 47*a* and 47*b* disposed within each strip 46 is normally situated adjacent but not in contact with each other. However, when the strip 46 comes into contact with an object during movement of the grates 4 and 8 and the strip 46 is compressed, contact elements 47*a* and 47*b* come into contact with each other thereby completing a control circuit (not shown) which automatically stops all movement of the grates 4 and 8. Movement of the grates 4 and 8 is then reversed to free the contacted object. Connection of the contact elements 47*a* and 47*b* with the control circuit is facilitated by a retracting safety cord and reel or self coiling cable (neither is shown) or similar appropriate means.

It should be readily recognized that the sensors 44 and 48 are standard in the industrial door industry and thus well-known. Sensors 44 and 48 provide the desired advantage of reversing the movement of covers 4 and 8 when a person or object is stuck between them, thereby preventing a possible double calamity of crushing the object or person situated therebetween and jamming or possibly burning out the automated opening and closing system. It will be recognized that sensors 44 and 48 are mounted to retracting components (not shown) which automatically pull the sensors 44 and 48 behind the edges 4*a* and 8*a* when edges 4*a* and 8*a* are about to meet, thereby allowing for full closure of the grates 4 and 8. This arrangement is also common in the industrial door industry.

As a warning system, the control box 24 has been equipped with both a visual and an audible signal device in the form of a rotating beacon light 52 and a bell alarm 56. Both of these are automatically activated when grates 4 and 8 are set into motion by an operator. Light 52 and bell 56 serve to warn persons in the vicinity of the pit 12 of the movement of the grates 4 and 8 to enable them to move or otherwise act to avoid possible accidents.

It is to be understood that the above described arrangements are only illustrative of the application of the principles of the present invention. Numerous modifications and alternative arrangements may be devised by those skilled in the art without parting from the spirit and scope of the present invention and the appending claims are intended to cover such modifications and arrangements.

What is claimed is:

1. A movable inspection pit cover adapted for use with an inspection pit having an elongated inspection opening over which a vehicle can be driven so that the vehicle straddles the inspection pit opening so that the underside of said vehicle can be inspected or serviced, the inspection pit cover comprising:

a first rigid, substantially planar cover positioned over at least a portion of the inspection pit, the first cover having dimensions such that the vehicle can straddle the first cover as the first rigid, substantially planar cover is moved over the inspection pit, the first rigid, substantially planar cover being configured such that a worker above or in the pit cannot lift the cover out of its horizontal orientation over the inspection pit;

a second rigid, substantially planar cover positioned over at least a portion of the inspection pit, the second cover having dimensions such that the vehicle can straddle the second cover as the second rigid, substantially planar cover is moved over the inspection pit, the second rigid, substantially planar cover being configured such that a worker above or in the pit cannot lift the cover out of its horizontal orientation over the inspection pit;

a first base support element disposed along a first elongated side of the inspection pit and not substantially extending beyond the side of the inspection pit;

a second base support element disposed along a second elongated side of the inspection pit and not substantially extending beyond the side of the inspection pit;

a plurality of rollers disposed on the first cover and on the second cover such that the rollers engage the first and the second base support elements allowing the first and the second covers to move along the length of the inspection pit such that the neither the first cover nor the second cover extend substantially beyond the width of the inspection pit and such that the first cover and the second cover simultaneously move apart during opening of the covers to expose at least a portion of the inspection pit and simultaneously move together during closing of the covers to substantially cover the inspection pit, the plurality of rollers comprising means for guiding the first and the second covers linearly along the first and second base support elements;

driving means for selectively applying force to both the first cover and the second cover in opposing directions in order to simultaneously move the first and the second covers apart from each other to expose at least a portion of the inspection pit such that the driving means engages the first and second covers so that the motion of the first and covers apart from each other can be stopped at any time and such that the first and second covers do not move in an opening direction unless the driving means is engaged and for applying force to both the first cover and the second cover in converging directions in order to simultaneously move the first and second covers toward each other when closing the covers such that the driving means engages the first and second covers so that motion of the first and second covers toward each other can be stopped at any time and such that the first and second covers do not move in a closing direction unless the driving means is engaged; and a control box connected to the driving means and including means for manually directing the driving means and causing the opening, the closing, and the stopping at any time of the first and the second covers, the control box located outside of the inspection pit and being operable by a person positioned outside of the inspection pit such that when the vehicle is driven over the elongated inspection pit to straddle the same the first and the second covers can be opened to allow access to the underside of the vehicle and the first and second covers can be substantially closed any time regardless of whether a vehicle is straddling the inspection pit.

2. A movable inspection pit cover as defined in claim 1 wherein the driving means comprises:

a bidirectional motor;

a chain fixed to the cover; and gear means for transmitting the motion of the motor to the chain such that as the motor operates in a first direction the covers move apart and as the motor operates in a second direction the covers move together.

3. A movable inspection pit cover as defined in claim 2 wherein the control box includes an open switch, a close switch, and a stop switch.

* * * * *